United States Patent [19]

Jakob

[11] Patent Number: 4,922,933

[45] Date of Patent: May 8, 1990

[54] TOBACCO SEPARATION OR DELAMINATION METHOD

[75] Inventor: Stephen W. Jakob, Winston-Salem, N.C.

[73] Assignee: R. J. Reynolds Tobacco Company, Winston-Salem, N.C.

[21] Appl. No.: 14,557

[22] Filed: Feb. 13, 1987

[51] Int. Cl.[5] ..... A24B 3/06

[52] U.S. Cl. ..... 131/299; 131/294; 131/295

[58] Field of Search ..... 131/299, 294, 295

[56] References Cited

U.S. PATENT DOCUMENTS 3,699,976 10/1972 Abe et al. .
3,842,846 10/1974 Laszlo .
4,383,538 5/1983 Beard et al. .
4,590,954 5/1986 Gooden ..... 131/299
4,600,024 7/1986 Edwards .

FOREIGN PATENT DOCUMENTS 699725 11/1953 United Kingdom .
2141319 12/1984 United Kingdom .

*Primary Examiner*—V. Millin

[57] ABSTRACT

The constituents of a compacted tobacco mass can be easily separated by subjecting the mass to electromagnetic radiation in the radio frequency range.

5 Claims, 1 Drawing Sheet

TOBACCO SEPARATION OR DELAMINATION METHOD

BACKGROUND OF THE INVENTION

This invention relates to the processing of tobacco material, and in particular to the separation or delamination of compacted tobacco material.

During the processing steps of tobacco, tobacco leaves or strips are stored and handled in dry, compacted masses. For example, tobacco material generally arrives at primary processing areas from storage in the form of tersa bales, turkish bales or offshore boxes (i.e., having a generally rectangular cross section) or as hogsheads (i.e., having a generally circular cross section). Although the compacting of tobacco material provides for convenient and efficient storage and handling, such tobacco material is difficult to handle in later processing stages.

The separation of compacted tobacco material is necessary in order that further processing steps can be performed. However, compacted tobacco material can become brittle and can readily degrade into fine particles when the bales, boxes or hogsheads are opened and separation of the tobacco material is attempted.

The separation of compacted tobacco material has involved conditioning of the material in order to provide a moist and flexible material. Generally, the conditioning of a compacted tobacco mass is accomplished through the use of steam and/or water. For example, steam can be applied to the compacted mass through the use of a penetrating probe or vacuum in order to promote penetration thereof into compacted mass. Representative methods for steam conditioning a tobacco mass are disclosed in U.S. Pat. No. 4,383,538 to Beard et al. However, steam treatment of compacted tobacco material requires controlled processing steps which can prove cumbersome to perform. In addition, careful control of the processing steps are required in order to provide an evenly conditioned tobacco mass. For example, steam treatment often provides unevenly conditioned material thus causing the formation of pads or clumps of tobacco mass.

U.S. Pat. No. 4,600,024 to Edwards proposes a process whereby packed or compacted tobacco leaves are subjected to microwave radiation in order to provide ready separation of the compacted mass. However, microwave treatment of tobacco can be expensive, requiring multiple frequency generators. In addition, cumbersome shielding steps need to be taken in order to minimize or prevent escaping microwave radiation from the system. Furthermore, in certain situations, the microwave radiation may have a limited depth of penetration into a compacted tobacco mass.

It would be highly desirable to provide a method for efficiently and effectively separating compacted tobacco material or compacted tobacco masses.

SUMMARY OF THE INVENTION

The present invention relates to a process for reducing the force needed to separate the constituents of a compacted tobacco mass. The process involves subjecting the compacted tobacco mass to electromagnetic radiation in the radio frequency range. For example, compacted tobacco leaves which are intertwined, or tobacco leaves or strips which adhere to one another due to the compression caused by the packing of the mass can be easily separated with reduced force and reduced breakage of the tobacco material.

The process of this invention provides a manner for changing the integrity of the packed or compacted tobacco mass from a bulk solid to a more free flowing form. In particular, compacted tobacco leaves or sheets which traditionally require relatively great amounts of force to separate can be readily separated or delaminated upon heating using radio frequency radiation. The heated mass of tobacco can be separated quite readily in view of the fact that the individual pieces of tobacco exhibit a pliable characteristic upon heat treatment. The compacted mass can undergo delamination, or the various pieces of tobacco material can be separated without significant breakage thereof.

Upon cooling, the separated tobacco is provided in an essentially dry, workable form. The separated tobacco material can be collected, moistened (i.e., conditioned), and employed in further processing steps for the manufacture of smoking articles.

DETAILED DESCRIPTION OF THE EMBODIMENTS

Figure 1:
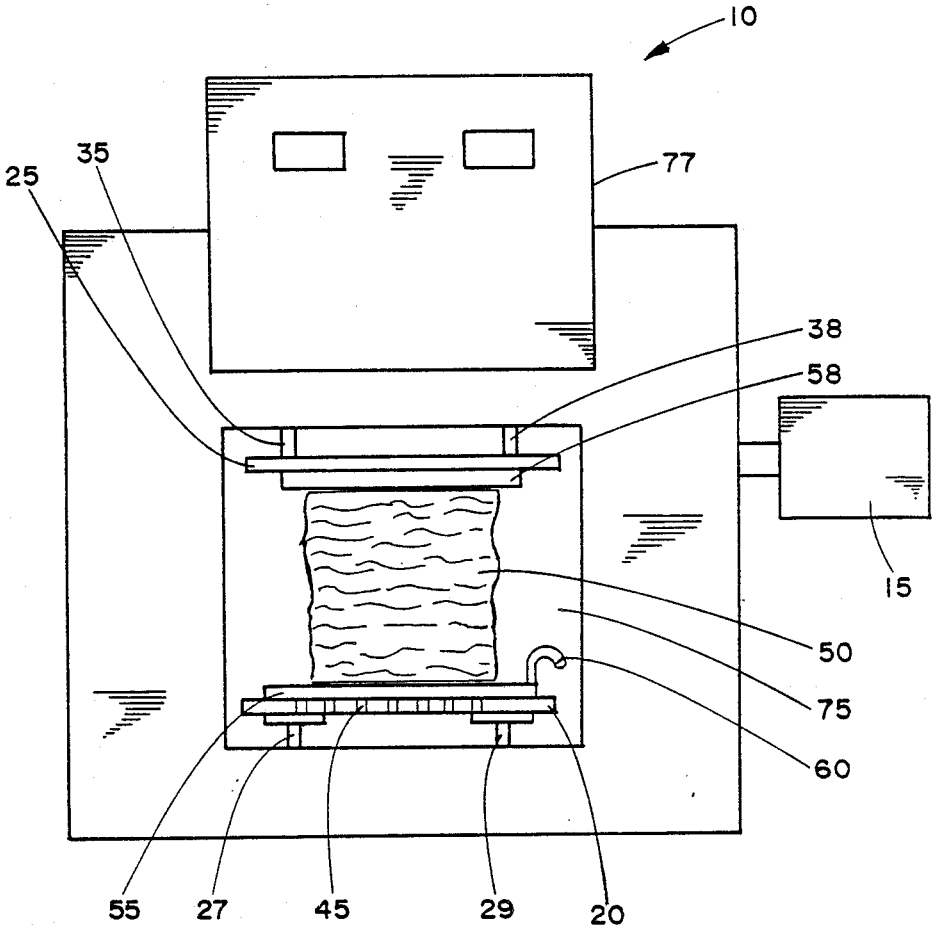
FIG. 1 is a diagrammatic illustration of the apparatus useful in the process of this invention showing the container, the door in the opened position, a bale of compacted tobacco material positioned between the electrodes and the radio frequency generator.

Referring to FIG. 1, the apparatus 10 includes a radio frequency generator 15. The radio frequency generator is connected to electrodes 20 and 25, respectively. One electrode is a positive electrode and one electrode is a negative electrode. The electrodes 20 and 25 are in the form of plates, the faces of which are positioned essentially parallel to one another, and are manufactured from aluminum, non-ferrous alloys, or the like. Typically, the areas of the exposed faces of the two plates are about equal. However, other electrode shapes and arrangements are possible.

As shown in FIG. 1, the electrode plates 20 and 25 are arranged in a horizontal plane, wherein lower plate 20 is movable vertically using adjustment means 27 and 29; and upper plate 25 is supported by support means 35 and 38. Thus, the relative vertical distance between the plate 20 and 25 can be adjusted.

The upper plate 20 is equipped with a facing 40 which is transparent to radio frequency radiation. For example, a sheet of polypropylene having a thickness of about 0.5 inch to about 1 inch can be adhesively secured to the bottom surface of the upper plate 20.

The bottom plate 30 is equipped with air jets 45 or other such means for allowing for easy movement of the compacted mass of tobacco material shown as bale 50. In particular, bale 50 is placed on pallet 55 and positioned between plates 20 and 25. The pallet can be equipped with handle 60 or other means for effecting movement of the pallet and bale. The pallet 55 is manufactured from a material capable of supporting the bale, and is non-conductive of electricity but transparent to radio frequency. For example, the pallet can be manufactured from a sheet of polypropylene having a thickness of about 0.5 inch to about 1 inch, a sheet of polyethylene, a wood pallet, or the like.

The bale 50 of compacted tobacco material is placed in the apparatus between the plates 20 and 25. The vertical distance between the plates is adjusted in order that each plate is generally parallel to the adjacent top and bottom faces of the bale. Each plate is preferably positioned less than about 1 inch from the adjacent faces of the bale. The desired distance between the plates and the bale can be accomplished by the proper selection of pallet 55 (i.e., such that the pallet has the desired thickness), and facing 58 which is positioned on the face of upper plate 25. Thus, adjustment means 27 and 29 can be adjusted until the facing 58 rests on the top face of bale 50. The facing 58 acts to assist in accounting for unevenness in the top surface of the bale 50, and acts to prevent sticking of tobacco material to the electrode plate 25.

The apparatus includes a container means 70 which is constructed from aluminum, or the like. The container means is equipped with an opening 75 or other such means in order that the bale can be introduced into the apparatus and removed therefrom. The opening is closed and sealed by movable panel or door 77, or the like. The container means 70 is secured shut during operation of the apparatus in order to minimize or prevent scattering of radiation to regions outside the apparatus. The apparatus can include a means for controlling the relative humidity and temperature of the environment within the container.

The radio frequency generator 15 is designed for practical applications, to generate frequencies in the industrial frequency range (i.e., 40.6 MHz, 27 MHz or 13 MHz). The radio frequency generator operates in a conventional manner, well known to those skilled in the art, to impose an electromagnetic field between plates 20 and 25 which consequently acts to raise the temperature of the bale 50 therebetween.

Compacted tobacco material can have a variety of forms. For example, the tobacco material can be processed according to this invention from bales, from boxes, from hogsheads, or other such boxes, cases, containers, or the like. Generally, such tobacco is in the form of destemmed leaf lamina (i.e., strip) or in the form of whole leaf. Typically, the volume of the compacted mass ranges from about 4 cubic feet to about 54 cubic feet; while the weight of the compacted mass ranges from about 40 pounds to about 1,000 pounds.

The time over which the compacted tobacco material is subjected to radiation treatment can vary and is dependent upon a variety of factors. For example, large size, heavy bales of compacted tobacco mass can take relatively long periods of time in order to complete sufficient radiation treatment while smaller bales take less time. Moist bales typically take relatively short periods of time in order to complete sufficient radiation treatment. An apparatus generating a large amount of power typically can be employed to treat a bale in a relatively short period of time. For most applications, (when employing a radio frequency generator capable of delivering about 30 KW of power), the compacted mass of tobacco weighing less than about 250 pounds can be heated to the desired temperature upon exposure to the radio frequency radiation for less than about 20 minutes. Generally, it is desirable to heat the mass of compacted tobacco to an average temperature in the range from about 120° F. to about 212° F., preferably from about 140° F. to about 190° F.

If desired, the compacted tobacco mass can be subjected to RF radiation using a batch process or a continuous process. An example of equipment suitable for performing a batch process is illustrated in FIG. 1. However, a continuous process can be accomplished by using a suitably equipped RF generating unit having a feed means such as a conveyor belt for passing the compacted tobacco mass through the unit. In addition, such a unit is desirably equipped with suitable RF radiation traps. A continuous process may not require the manual movement of the compacted tobacco mass (which may be desirable using a batch process). For example, in a unit used for a continuous process, the orientation of the various electrode plates within a series of electrodes can have differing positionings.

After being subjected to radio frequency radiation, the tobacco material is removed from the apparatus and is subjected to some form of agitation in order to reduce the compacted material to form separated, delaminated individual leaves or strips. The agitation can be provided by tumbling, shaking, vibrating, or the like. After being separated or during separation stages, the leaves can be conditioned using moisture (eg., in the form of water or steam), humectants, casing, and the like. The separated and conditioned material is further processed for the manufacture of smoking articles such as cigarettes.

The process of this invention minimizes or eliminates the formation of pads within a packed or compacted mass of tobacco. Thus, separation or delamination of compacted tobacco material can be performed in an efficient and effective manner with reduced degradation (i.e., breakage) of the tobacco material during the separation process steps.

The following examples are provided in order to further illustrate the invention but should not be construed as limiting the scope thereof.

EXAMPLE 1

Flue-cured tobacco material in strip form of various sizes is removed from an offshore box. The compacted mass weighs about 440 pounds and has dimensions of 27 inches by 28 inches by 44.5 inches. The mass is split into two sections, each section having a generally rectangular shape and having dimensions of about 27 inches by 14 inches by 44.5 inches.

One section of the compacted mass weighing 214 pounds is placed on a polypropylene pallet and positioned between the electrode plates of the treatment chamber of a radio frequency generating apparatus. The apparatus is generally illustrated in FIG. 1. The apparatus is commercially available as a RFC Model 960 from Radio Frequency Co., Millis, Mass.; has a Macrowave 30 KW radio frequency generator; and operates at a wave length of 40.6 Megahertz. The apparatus is equipped with a unit designed for detecting arcing, and a corresponding unit for stopping radiation emission when arcs are detected. The apparatus also has the ability to automatically continue radiation generation after a few seconds of downtime. In addition, the apparatus is equipped with a unit to shut radiation generation down if too many arcs are sensed to occur during a given time period.

The compacted mass is positioned such that the sides thereof having dimensions of 27 inches by 44.5 inches are positioned essentially parallel to the electrode plates. The tobacco strips are aligned such that they are generally parallel to the plates. The top electrode plate has a facing of polypropylene having a thickness of $\frac{5}{8}$ inch. The height of the bottom plate is adjusted such that the polypropylene facing rests against the top face of the compacted tobacco mass. The faces of the electrode plates are thereby spaced apart by a vertical distance of about 15.25 inches.

The door of the outer container is shut and the control amperage of the radio frequency generating unit is adjusted from about 2 amperes to about 2.5 amperes. Such conditions are maintained for about 2 minutes. The radiation then is ceased, the compacted tobacco mass is rotated 90° in the horizontal plane, and aforementioned radiation treatment is repeated for another 2 minutes. This process is repeated in order that the tobacco mass is rotated a total of six times, and is subjected to a total of 14 minutes of radiation treatment.

The compacted mass is removed from the apparatus and exhibits an average temperature of about 156° F. The average temperature is determined by averaging the temperatures determined using 9 thermocouples positioned at different regions of the surface the mass, but positioned so as to extend about 6 inches into the mass. The temperature differential throughout the bale ranges from 127° F. (measured near the top of the mass) to 183° F. (measured near the middle of the mass).

The compacted mass so treated can be delaminated easily.

EXAMPLE 2

Burley tobacco is removed from an offshore box. The compacted mass weighs about 440 pounds and has dimensions of 27.5 inches by 27 inches by 44.5 inches. The mass is split into two sections. One section is a compacted mass weighing about 210 pounds and has dimensions of 27.5 inches by 44.5 inches by 13.5 inches. The compacted mass is placed on a polypropylene pallet such that the sides thereof having dimensions of 27.5 inches by 44.5 inches are positioned essentially parallel to the top face of the pallet.

The bale and pallet is positioned in the treatment chamber of the radio frequency generating apparatus described in Example 1. The height of the bottom plate is adjusted as described in Example 1 such that the electrode plates are spaced apart by a vertical distance of about 14.75 inches.

The door of the outer container is shut and the control amperage of the radio frequency generating unit is adjusted from about 2 amperes to about 2.5 amperes. Such conditions are maintained for about 2 minutes. The radiation then is ceased, the compacted tobacco mass is rotated 90° in the horizontal plane, and aforementioned radiation treatment is repeated for another 2 minutes. This process is repeated in order that the tobacco mass is rotated a total of 4 times, and subjected to a total of 10 minutes of radiation treatment.

The compacted mass is removed from the apparatus and exhibits an average temperature of about 165° F. The average temperature is determined by averaging the temperatures determined using 9 thermocouples positioned at different regions throughout the mass as described in Example 1. The temperature differential throughout the bale ranges from 120° F. to 207° F.

The compacted mass so treated can be delaminated easily.

EXAMPLE 3

Burley tobacco is removed from an offshore box. The compacted mass weighs about 440 poounds and has dimensions as described in Example 2. The mass is split into two sections. One section is a compacted mass weighing about 220 pounds and has dimensions of 27.5 inches by 44.5 inches by 13 inches. The compacted mass is placed on a polypropylene pallet such that the sides thereof having dimensions of 27.5 inches by 44.5 inches are positioned essentially parallel to the top face of the pallet.

The bale and pallet is positioned in the treatment chamber of the radio frequency generating apparatus described in Example 1. The height of the bottom plate is adjusted as described in Example 1 such that the electrode plates are spaced apart by a vertical distance of about 14.25 inches.

The door of the outer container is shut and the control amperage of the radio frequency generating unit is adjusted from 2 amperes to about 2.5 amperes. Such conditions are maintained for about 2 minutes. The radiation then is ceased, the compacted tobacco mass is rotated 90° in the horizontal plane, and aforementioned radiation treatment is repeated for another 2 minutes. This process is repeated in order that the tobacco mass is rotated a total of 6 times, and subjected to a total of 14 minutes of radiation treatment.

The compacted mass is removed from the apparatus and exhibits an average temperature of about 202° F. The average temperature is determined by averaging the temperatures determined using 9 thermocouples positioned at different regions throughout the mass as described in Example 1. The temperature differential throughout the bale ranges from 168° F. to 224° F.

The compacted mass so treated can be delaminated easily.

EXAMPLE 4

Turkish tobacco wrapped in a burlap bale weighs about 115 pounds and has dimensions of 13.5 inches by 26.5 inches by 24.5 inches. The compacted mass is placed on a polypropylene pallet such that the sides thereof having dimensions of 24.5 inches by 13.5 inches are positioned essentially parallel to the top face of the pallet.

The bale and pallet is positioned in the treatment chamber of the radio frequency generating apparatus described in Example 1. The height of the bottom plate is adjusted as described in Example 1 such that the electrode plates are spaced apart by a vertical distance of about 27.75 inches.

The door of the outer container is shut and the control amperage of the radio frequency generating unit is adjusted from about 1.5 amperes to about 2 amperes. Such conditions are maintained for about 2 minutes. The radiation then is ceased, the compacted tobacco mass is rotated 90° in the horizontal plane and end over end, and aforementioned radiation treatment is repeated for another 2 minutes. This process is repeated in order that the tobacco mass is rotated a total of 5 times, and subjected to a total of 11 minutes of radiation treatment.

The compacted mass is removed from the apparatus and exhibits an average temperature of about 155° F. The average temperature is determined by averaging the temperatures determined using 9 thermocouples positioned at different regions throughout the mass as described in Example 1. The temperature differential throughout the bale ranges from 126° F. to 195° F.

The compacted mass so treated can be delaminated easily.

EXAMPLE 5

Turkish tobacco wrapped in a burlap bale weighs about 115 pounds and has dimensions of 15 inches by 25 inches by 26 inches. The compacted mass is placed on a polypropylene pallet such that the sides thereof having dimensions of 25 inches by 15 inches are positioned essentially parallel to the top face of the pallet.

The bale and pallet is positioned in the treatment chamber of the radio frequency generating apparatus described in Example 1. The height of the bottom plate is adjusted as described in Example 1 such that the electrode plates are spaced apart by a vertical distance of about 27.25 inches.

The door of the outer container is shut and the control amperage of the radio frequency generating unit is adjusted from about 1.5 amperes to about 2 amperes. Such conditions are maintained for about 2 minutes. The radiation then is ceased, the compacted tobacco mass is rotated 90° in the horizontal plane and end over end, and aforementioned radiation treatment is repeated for another 2 minutes. This process is repeated in order that the tobacco mass is rotated a total of 6 times, and subjected to a total of 14 minutes of radiation treatment.

The compacted mass is removed from the apparatus and exhibits an average temperature of about 193° F. The average temperature is determined by averaging the temperatures determined using 9 thermocouples positioned at different regions throughout the mass as described in Example 1. The temperature differential throughout the bale ranges from 137° F. to 225° F.

The compacted mass so treated can be delaminated easily.

What is claimed is:

1. A method for reducing the force to separate the constituents of a stored, compacted tobacco mass, the method comprising subjecting the compacted tobacco mass, after storage, to irradiation with electromagnetic waves in the radio frequency range.

2. The method of claim 1 whereby the frequency range is in the industrial frequency range.

3. The method of claim 1 whereby the compacted mass is subjected to irradiation for a period of time sufficient to increase the average temperature thereof to within a temperature range of from about 140° F. to about 190° F.

4. The method of claim 1 whereby the compacted tobacco mass weighs from about 40 pounds to about 1,000 pounds.

5. The method of claim 3 whereby the compacted tobacco mass is subjected to exposure to radio frequency radiation for less than about 20 minutes.

* * * * *